US005092259A

United States Patent [19]

Husain

[11] Patent Number: 5,092,259

[45] Date of Patent: Mar. 3, 1992

[54] INERT GAS CONTROL IN A SYSTEM TO REDUCE SPILLAGE OF OIL DUE TO RUPTURE OF SHIP'S TANK

[76] Inventor: Mo Husain, 908 Stratford Ct., Del Mar, Calif. 92104

[21] Appl. No.: 503,712

[22] Filed: Apr. 3, 1990

Related U.S. Application Data

[63] Continuation-in-part of Ser. No. 377,886, Jul. 10, 1989.

[51] Int. Cl.[5] ..... B63B 25/08

[52] U.S. Cl. ..... 114/74 R; 114/229

[58] Field of Search ..... 114/72, 73, 74 R, 74 A, 114/227-229; 220/1 B, 5 A, 1 V, 85 S, 85 VR, 85 VS, 900

[56] References Cited

U.S. PATENT DOCUMENTS

| | | | |
|---|---|---|---|
| 3,285,711 | 11/1966 | Stanford | 440/89 X |
| 3,669,055 | 6/1972 | Buce | 114/299 |
| 4,161,155 | 7/1979 | Cloutier | 114/227 |
| 4,446,804 | 5/1984 | Kristiansen et al. | 114/74 R |

FOREIGN PATENT DOCUMENTS

| | | | |
|---|---|---|---|
| 2031905 | 1/1971 | Fed. Rep. of Germany | 114/74 R |

OTHER PUBLICATIONS

Spill Proof Oil-Tankers, a publication of Marine Journal 9-1989.

*Primary Examiner*—Ed Swinehart
*Attorney, Agent, or Firm*—William C. Fuess

[57] ABSTRACT

A system and method to reduce outflow of liquid such as oil due to the rupture of a ship's tank by means of creating, and continuing to maintain, a partial vacuum in the effected tank or tanks. A partial vacuum below atmospheric pressure is created in the ship's tank. The vacuum is continuously maintained in a precise balance responsive to the forces acting on the contents of the tank, which forces change when the tank is ruptured. If the rupture is below the water line and on the side hull, then surface tension dynamics induce a stratified flow, forcing water into the tank through the lower part of the rupture while forcing the oil upward and out of the tank, oppositely to the flow of water, until the water level reaches the top part of the rupture. In accordance with the preferred embodiment of the invention even the stratified flow is stopped because a non-structural barrier is placed over the rupture. This non-structural barrier reduces the surface tension dynamics that otherwise arise between the two liquids, oil and water, of dissimilar viscosity. The non-structural barrier is typically a tarpaulin. It is placed over the rupture while the partial vacuum is dynamically maintained. The combination of dynamic underpressure control and a non structural barrier substantially forestalls oil outflow.

The system also maintains an inert gas in the ullage spaces above the oil in the tank in order to prevent explosion. Inert gas concentration conforms with International Maritime Organization and U.S. Coast Guard norms even though the gas pressure in the ullage spaces is negative, i.e. below the atmospheric pressure level.

22 Claims, 4 Drawing Sheets

| OPERATIONAL PHASES | FUNCTION | REQUIRED OPERATION SYSTEM | |
|---|---|---|---|
| | | Inert Gas System | Active Pressure System |
| Inert empty cargo tanks | Inert gas introduced to displace the air and reduce oxygen content < 8% and a small positive gas pressure | X | |
| Loading cargo | Maintain inert requirements | X | |
| Voyage | Set the required underpressure prior to and during the voyage | | X |
| Unloading | Return to positive pressure of inert system | X | X |
| Gas freeing/ purging | Fresh air into a tank to remove toxic, flammable and inert gas | X | |
| Emergency unloading | Emergency Transfer System | X | X |

FIG. 7

INERT GAS CONTROL IN A SYSTEM TO REDUCE SPILLAGE OF OIL DUE TO RUPTURE OF SHIP'S TANK

The present application is a continuation-in-part of U.S. Pat. application Ser. No. 377,886 filed July 10, 1989 for a SYSTEM TO REDUCE SPILLAGE OF OIL DUE TO RUPTURE OF A SHIP'S TANK, which predecessor application is to the same inventor as the present application.

BACKGROUND OF THE INVENTION

This present invention concerns the prevention of oil spillage due to accidental rupture of a tank or tanks of a ship.

With the advent of supertankers, a single spill incident can (i) cause significant damage to the environment, (i) disrupt the ecological balance, and (i) cause substantial economic loss. The recent accident of EXXON VALDEZ is perhaps the worst oil spillage disaster in U.S. history. The EXXON VALDEZ leaked about 240,000 barrels—over 10 million gallons—of oil. The economic and environmental cost of the leak is estimated to have been over one billion dollars. Three weeks after the EXXON VALDEZ accident an Indian tanker spilled about a million gallons of oil in the vicinity of Saudi Arabia. Still another example of recent supertanker accident is the case of AMERICAN TRADER that spilled 400,000 gallons near Huntington Beach, Calif. on Feb. 7, 1990.

Previous efforts to control damage from accidental rupture to the tanks of ships have principally been limited to 'containment and dispersement' of the spilled oil. Although some emphasis has been made on naval architectural solutions to limit damage from spills—such as by adding a double bottom to the hull and by employing compartmentalized design and structural strengthening to prevent cracking of the hull—limited private and governmental resources have heretofore been directed to prevent the spillage of oil once a rupture to a ship's tank occurs. The present invention is concerned with preventing oil from spilling from ruptured vessel, including from an oil tanker of any size.

SUMMARY OF THE INVENTION

The principal object of the present invention is to provide an economical and low cost system for preventing liquids such as oil from escaping from the tank or tanks of a vessel carrying oil, once such tank or tanks are ruptured. The system can be retrofitted to existing vessels.

The invention retains liquids such as oil in the already ruptured tanks of vessels for time periods sufficient to permit other, undamaged, vessels to transfer the oil from the ruptured tanks to tanks of the undamaged vessels.

According to its avoidance of spills from ruptured tanks, the present invention eliminates and/or minimizes the environmental damage that is otherwise resultant from maritime accidents wherein oil is spilled. The present invention also eliminates or minimizes the economic loss resulting from spillage of oil from a ruptured ship's tank. Finally the present invention eliminates and/or minimizes the cost of cleanup after an oil spillage by preventing most of the spillage on the first instance.

The present invention eliminates the need for expensive modifications to the hull of a vessel as might otherwise be employed to reduce the spillage of liquid such as oil.

These objects of the invention are achieved by means of a system that (i) creates a partial vacuum in the ruptured tank or tanks by a device such as a pump, and (ii) maintains a precise balance of forces acting on the contents of the tank in consideration of both surface tension dynamics and stratified flow.

The device, or pumps, are flow connected by ducts to the spaces over the oil within the tanks. Air or gas flow through the ducts is controlled by devices such as valves operating under the control of computer such as an IBM 386. If necessary, the entry point of a duct into a tank may be passed through an air chamber.

The preferred system of the invention prevents stratified outflow of oil through a rupture due to surface tension dynamics by positioning a flexible barrier between the oil and water. Stratified flow occurs despite the partial vacuum in the ullage space if the rupture is at the vertical side of the hull.

The present invention accords for maintenance of inert gas in the void space above the oil level to prevent explosion. This inert gas is maintained less than atmospheric pressure.

Three subscale models of the invention has been successfully tested with use of oil inside a tank and water outside.

BRIEF DESCRIPTION OF THE DRAWING

For a more complete understanding of the invention and for further objects and values thereof references are now made to the accompanying drawings referred to as FIGURES, which drawings include a cross-sectional diagram of hypothetical rupture locations, a cross-sectional diagram of a hypothetical rupture location and stratified flow of oil, a schematic of a preferred arrangement the system in an oil tanker, a diagram depicting Equilibrium of Forces, a diagram depicting an approximate loading condition of EXXON VALDEZ on Mar. 24, 1990, a profile drawing of a tanker showing a hypothetical loading condition of cargo, and a table setting forth the operational scenario of a system in accordance with the present invention.

FIG. 7 is a table setting forth a preferred operational scenario of a preferred system in accordance with the present invention.

DESCRIPTION OF THE PREFERRED EMBODIMENT OF THE INVENTION

The present invention contemplates a system and method for preventing, reducing, or minimizing the oil flow from a ruptured tank or tanks of vessels, and ocean based platforms.

The present invention prevents the outflow of oil through a rupture of tank(s) by creating an underpressure in the ullage space and dynamically maintaining the underpressure. The underpressure results in an equilibrium of forces around the rupture to prevent the outflow of oil through the rupture.

Figure 4:
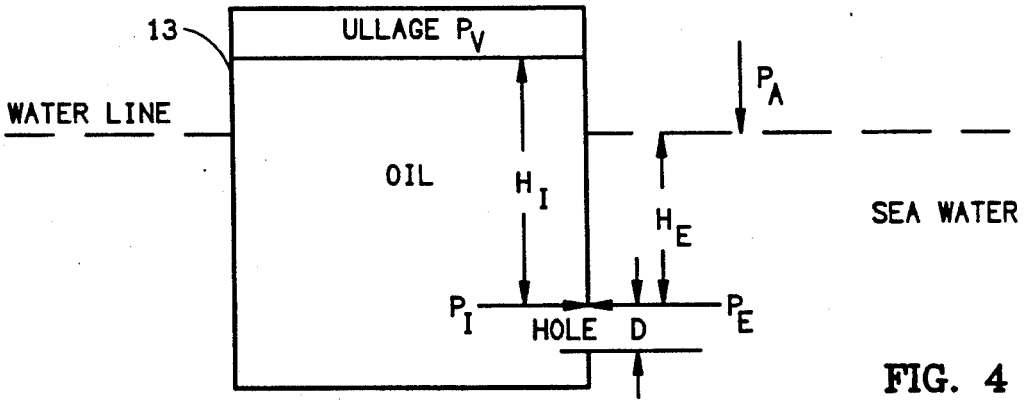
FIG. 4 is a diagram depicting the equilibrium of forces achieved by operation of the present invention.
Figure 5:
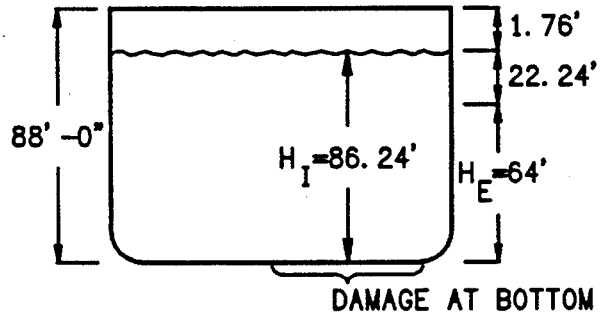
FIG. 5 is a diagram depicting an approximate loading condition of EXXON VALDEZ during the time of the accident on Mar. 24, 1989.

Forces acting on a ruptured tank are shown FIG. 4. The FIG. 4 depicts a tank floating in the ocean with a draft $h_e$, cargo loading (depth) $h_i$, the unfilled cargo volume (ullage) and a rupture at the bottom. If the underpressure in the ullage space is set to balance the forces internal to and external to the tank at the highest point of rupture, oil out-flow (spillage) will only occur up to the highest point of opening. The forces that predominate are the hydrostatic fluid pressures and the ambient and underpressure forces as follows:

For equilibrium $$P_E - P_I = 0 \quad (1)$$

where $P_E$=External Pressure $P_I$=Internal Pressure where $P_E$=Atmospheric Pressure ($P_A$)+Hydrostatic Water Pressure($\rho_\omega \times h_e$)

$P_I$=Controlled Ullage Pressure ($P_V$)+Hydrostatic Oil Pressure ($\rho_\omega \times h_i$)

From Equation (1)

$$P_E - P_I = 0$$

$$\text{or } P_I = P_E \quad (2)$$

$$\text{or } P_V + P_\omega \times h_\omega = P_A + P_\omega hd\ e \quad (3)$$

$$\text{or } P_V = P_A + P_\omega \times h_e - p_p \times h_i \quad (4)$$

where:

$P_\omega$=density of water $P_p$=density of oil $h_e$=height (external of water above rupture line $h_i$=height (internal) of cargo above rupture line In accordance with the invention, equilibrium is maintained. is constantly and dynamically maintained to be equal to $P_E$, regardless $P_E$ should vary.

A moderate reduction in pressure is required to balance the forces, and to ensure that the oil above the rupture is static and does not flow out. A few psi drop is all that is required. There is no need for high vacuum pumping.

Figure 6:
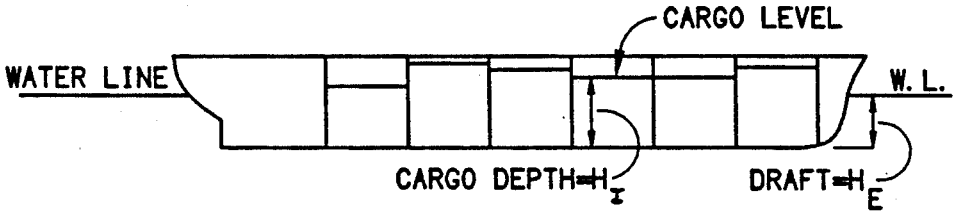
FIG. 6 is a profile drawing of a tanker of showing a hypothetical loading of cargo.

FIG. 6 shows approximate loading condition of EXXON VALDEZ during the time of accident on Mar. 24, 1989. The system of this invention can prevent in excess of 95% of the spillage of EXXON VALDEZ with 4.7 psi underpressure based on calculation as shown below:

$$P_V = P_A + \rho_\omega \times he - \rho_o \times hi$$

$$= 14.7 \times 144 + 64.27 \times 64 \text{ ft.} - 55.54 \times 86.24 \text{ ft.}$$

$$= 2116.8 + 4113.28 - 4789.77$$

$$= 1440.3 \text{ lb/ft}^2 = 10 \text{ psia} \approx 4.7 \text{ psi underpressure}$$

Where:

Density of oil $P_p$=55.54 lb/ft$^3$:

Density of water $P_\omega$=64.27 lb/ft$^3$

Atmospheric Pressure=14.7 psi=2116.8 lb/ft$^2$

The preferred system of the present invention further, and additionally, prevents a stratified outflow of oil at and below the level of rupture. This stratified outflow is due to surface tension dynamics. The preferred system of the present invention operates to forestall this outflow by positioning a flexible barrier between the oil and water.

The present invention operates to maintain a balance of forces in the vicinity of the ruptured hole despite the existing of surface tension dynamics. The balance of forces becomes far more complicated around the ruptured hole. Non-linear surface tension forces exist across the dissimilar fluids (oil/water). These tension forces result in a stratified flow, causing the water to displace the oil below the ruptured hole. If the volume of oil so displaced as a result of stratified flow, is to be prevented from spilling out the rupture then a non-structural barrier or a chemical barrier between the fluids must be placed between the fluids and across the ruptured hole. The non-structural barrier separates the molecules of the two dissimilar viscous liquids, and thus prevents the stratified flow.

Finally the preferred system of the present invention accords for maintenance for inert gas in the void space above the oil level in order to prevent explosion. This inert gas is maintained less than atmospheric pressure.

The preferred system includes air flow devices such as vacuum pumps 5, air communicating channels such as ducts 6, air flow control devices such as valves 7, electronic sensors, a control computer 11 and a barrier similar to flexible tarpaulin 10. The barrier may alternately be a rigid barrier or a chemical barrier The air handling devices such as vacuum pumps 5 are connected to the tank 12 or tanks by ducts 6. The vacuum pump 5 or pumps are controlled by computer 11, with manual override in case of failure of the computer system. The devices such as vacuum pumps 5 and devices such as valves 7 can also be totally manually controlled.

The partial vacuum condition in the ruptured tanks is created by pumping out air from the ruptured tanks by means of devices such as vacuum pumps 5. These pumps 5 are connected to the tank or tanks by ducting 6. They are gated by means of devices such as valves 7 under control of computer 11. The magnitude of outflow of air required to maintain the partial vacuum condition is dependent on (i) the waterline level outside the tank, (ii) the height of oil inside the tank, (iii) the vertical location of the rupture relative to the waterline outside the hull,(iv) and any air leakage through the seams and rivets, and the 'not-perfectly-tight' hatches, of the tank. The entry point of the duct into the tank is free of oil: only air space is allowed at the entrance of the duct 6 into the tank. If an operational requirement dictates the tank must be completely full then an air chamber 8 is placed on the top of the tank providing the seat on entry point for the duct 6. The existing inert gas system, if any, is retained and utilized.

In accordance with the invention (i) inert gas is introduced for desired concentration, and thereafter (ii) a vacuum pump 5 withdraws inert gases from the tanks to a pressure level that matches the internal pressure to the external pressure. The pressure level is dynamically maintained even upon the occurrence(s) of ruptures.

The preferred system further includes non-return and isolation valves 7, ducts 6, sensors to measure the tank liquid cargo level (similar to SAAB tank level indicator TLI) and a computer similar to an IBM 386 to determine the 18 required underpressure based on the tank's configuration, draft, cargo density and loading.

A data bus is used for the transmission of control data to a central computer. Such a data bus is typically of standard type, such as an Ethernet communication channel. The data communication is simple and trouble free because (i) only a low data rate is required, and (ii) control is preferably electric power is obtained by tapping into the ship's electric power system.

Two operational methods for introducing and maintaining the required underpressure in the tank are contemplated by the present invention.

Operational method #1. This method in accordance with the present invention is primarily designed to ensure that an stabilizing ullage underpressure exists in the tanks at the time accordance with operational method #1 underpressure is best realized by introducing (i) inert gas and (ii) evacuating the tanks to the required underpressure immediately after the tanks are loaded with oil. Immediate institution of the underpressure best accounts for accidents that may occur in proximity to the coastline, and in proximity to heavily populated areas. It is at these sites where the impact of spillage on the marine environment can be most disastrous.

Before execution of the first operational method, a cargo distribution plan is prepared to plan the loading of the tanker with liquid cargo. Each tank is filled to the desired level, as shown in FIG. 6. Then a computation is made to determine the underpressure required for each tank for a rupture at each tank's bottom. This rupture of tanker's bottom shell requires the maximum amount of underpressure. FIG. 7 summarizes the operational scenario of the Operational Method #1 of this invention.

Operational method #2. The second operational method is preferred where the flammability of the cargo is minimal, when the void space above the liquid level is small, and/or when an inert gas system is not in use. In this second method the ullage space of each tank is initially neither (i) filled with inert gas nor (ii) evacuated to a predetermined calculated underpressure. In the case of a rupture below the waterline, immediately after the rupture occurs a determination of which tank has ruptured is made by means of sensors. The sensing may be by use of tank level indicator (TLI) sensors in the tank, or by flow meter sensors attached to the inside of the hull, or by physical inspection. The sensors are linked to the computer 11. After the determination of which tanks are ruptured, a vacuum pump or pumps 5 is (are) activated to create a partial—vacuum below 11 the atmospheric pressure level—in the ruptured tanks until an equilibrium condition is reached.

Figure 1:
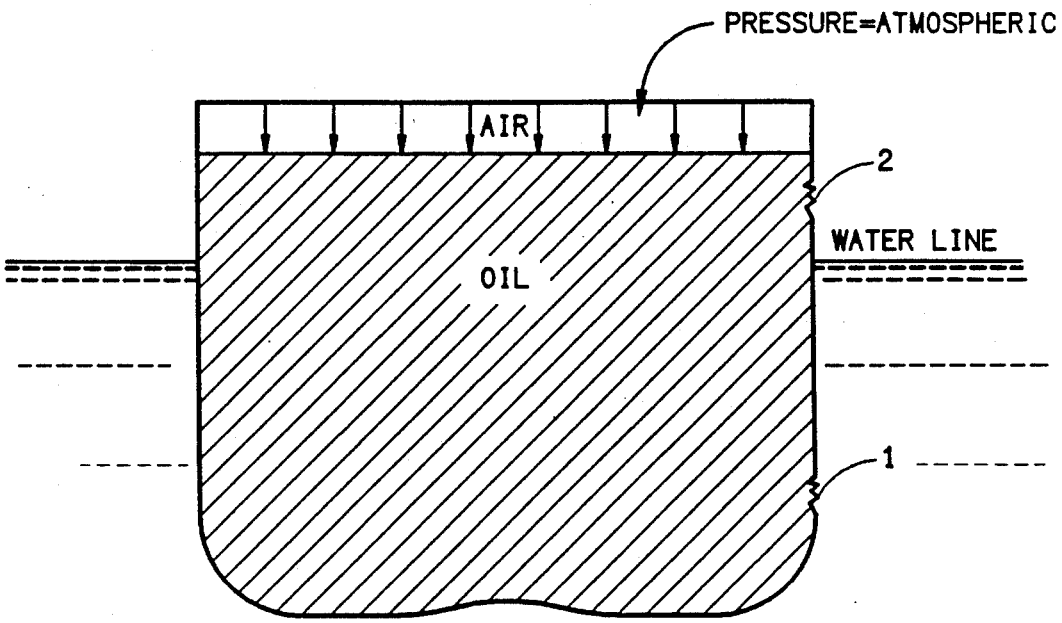
FIG. 1 (PRIOR ART)
FIG. 1 is a diagram in cross sectional view of hypothetical rupture locations on a ship's hull.
Figure 2:
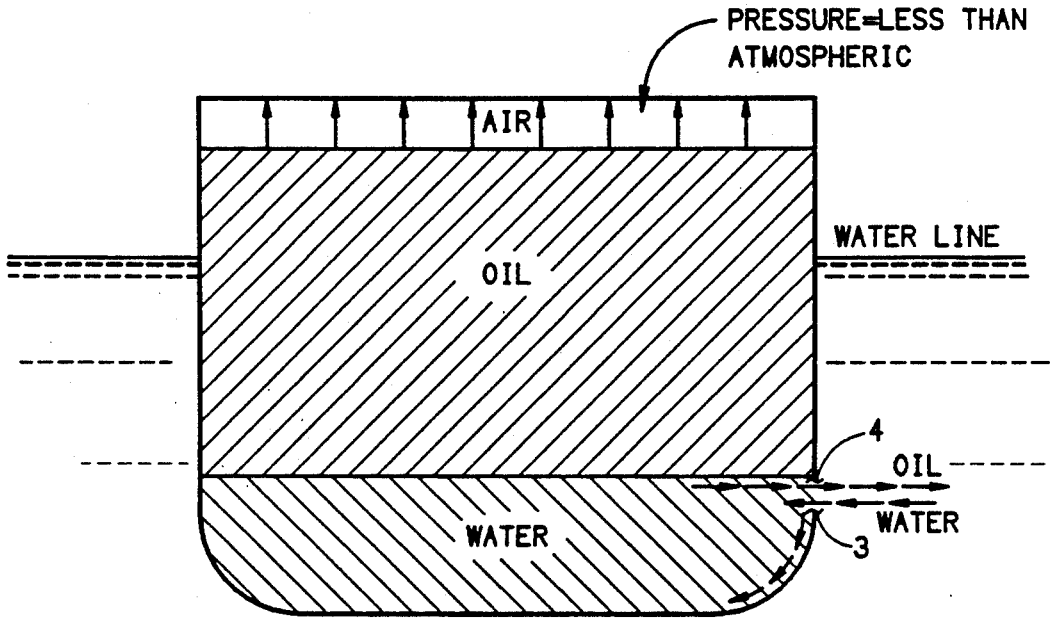
FIG. 2 (PRIOR ART)
FIG. 2 is a diagram in cross sectional view of one hypothetical rupture location and stratified flow at this rupture location.
Figure 3A:
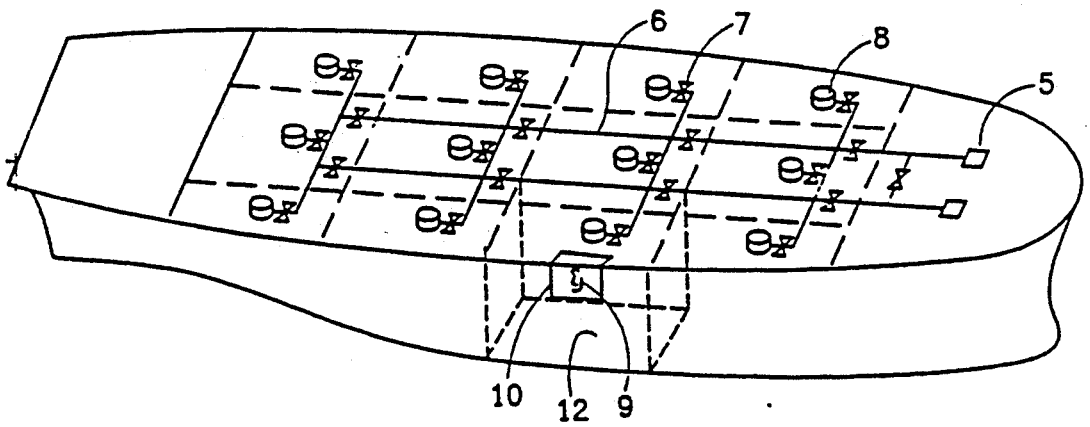
FIG. 3 is a schematic showing a preferred arrangement of the system of the present invention in an oil tanker.
Figure 3B:
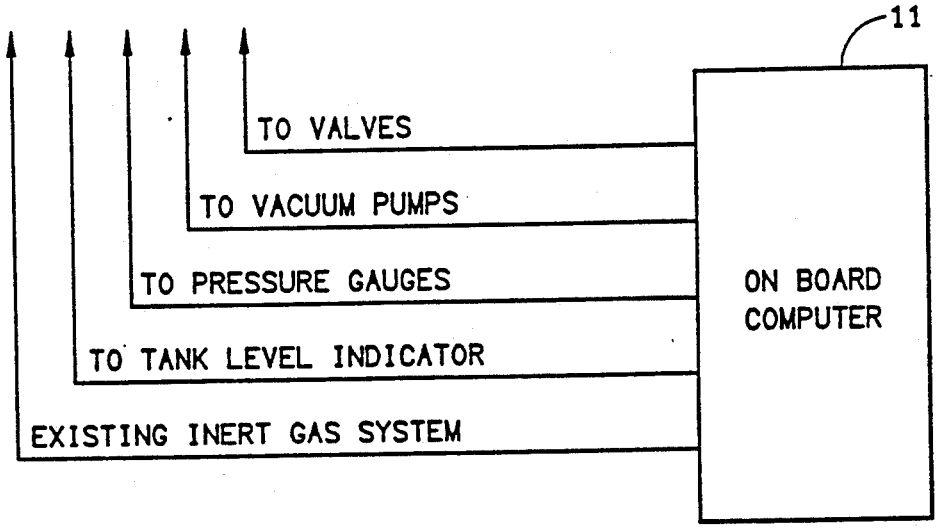

In case of rupture 2 above the waterline (FIG. 1), & or a rupture 9 above the waterline (FIG. 3) ( such as hull cracks), a flexible barrier such as tarpaulin 10 is placed over the rupture.

The entire system of the present invention can be considered as a module. The module can be retrofitted into the existing inert gas system presently employed on most oil tankers. In addition to the inert gas system blowers, the preferred system of this invention requires a separate duct system with (i) an exhaust pump and (i) isolation valves to reduce the inert gas pressure to that required for active underpressure control. Once the ullage space of the loaded cargo tanks has been rendered inert to the required safe oxygen content in strict accordance with International Maritime Organization (IMO) and U.S. Coast Guard guidelines and has momentarily been raised to a pressure a pressure slightly higher than ambient (so that a momentary testing may show that the tanks are leak proof), then the dynamic pressure control system of this present invention takes over, and continuously produces and dynamically maintains an underpressure in each ullage space while the tanker is deployed in the marine environment. The active pressure control approach of the invention ensures a continuous, dynamic availability of the desired level so as to minimize the outflow of pollutants from a damaged vessel.

The flammability of ullage gas mixture is due to its (i) hydrocarbon vapor and (ii) oxygen components. The lower and upper limits of flammability of a mixture of hydrocarbon gas and air are 7% and 10% hydrocarbon by volume. Below and above these concentrations flames will not propagate. Safe maintenance practice in accordance to International Maritime Organization (IMO) requires inert gas to displace the air in the tank until the oxygen content is below the 10% Rendering the ullage gas mixture inert also reduces the flammable range to practically zero at this level of oxygen concentration. At this level no mixture at any concentration of hydrocarbon can burn.

Typically, initial inerting of the ullage gas commences with introduction of inert gas to displace the air, until the oxygen content is below 8%, while the pressure is slightly above ambient thereby being below the limit. The system of this invention then comes into play. It reduces the pressure by removing some of the inert gas mixture. This operation results in the oxygen content remaining essentially unchanged. Meanwhile the hydrocarbon content may actually increase. This increased concentration of hydrocarbon does not constitute a risk, because the oxygen content is still below the 8% by volume limit, and because the increased hydrocarbon content does not move the gas mixture into the flammable zone.

The method and system of the present invention accommodates volatility in the liquid cargo. The technical prerequisites with regard to the vapor pressure of different oil qualities must ensure that the oil be remains a liquid at all times. This maintenance of the liquid state requires an externally imposed pressure that exceeds the saturated vapor pressure corresponding to the temperature of the oil. About 35% of all oil products have vapor pressure below 7 psia, so this requires that the underpressure should not exceed 7 psia. Such an extreme underpressure is not required by the use of the system or method of the present invention.

The method and system of the present invention is compatible with a ship's structural capability to withstand underpressure in the hold: the structural capability to withstand underpressure varies based on the vessel design. Although it appears that great majority of the tankers can generally withstand an underpressure of 7 psi, it is necessary to determine the structural capability of each tank of similar classes of tankers. Based on that determination of structural strength a 'not-to-exceed' value is assigned to each tanker. A relief valve is set accordingly in order to prevent buckling of ship's structures.

Three subscale models have been successfully tested with oil inside the tank and water outside. No significant oil is spilled for ruptures both above and below the waterline.

While the preferred embodiment of the invention has been disclosed, modifications can be made to this embodiment, and other embodiments of the invention can be devised, without departing from the spirit of the invention and the scope of the following claims.

What is claimed is:

1. A system to reduce spillage of oil due to a rupture of ship's tank containing oil, the system comprising:

means for creating a non-explosive mixture of gases in an ullage space of the ship's tank containing oil; and means for maintaining a pressure less than atmospheric pressure within the ullage space of the ship's tank so that internal and external pressure forces acting on the oil contents of the tank at a site of the rupture to such tank will be in balance regardless that such forces should vary upon the occurrence, and upon the location, of the rupture to such tank.

2. The system according to claim 1 wherein the means for creating is creating the non-explosive mixture of gases, and the means for maintaining this non-explosive mixture of gases at the pressure less than the atmospheric pressure, commencing at a time prior to a voyage of the ship.

3. The system according to claim 1 wherein the means for maintaining comprises:

gas pumping means for maintaining the pressure that is less than the atmospheric pressure substantially continuously during a voyage of the ship.

4. The system according to claim 1 wherein the means for creating comprises:

means for filling the ullage space above the liquid level of the ship's tank's oil with inert gas so as to produce a mixture of air, inert gas and evaporated hydrocarbon vapors; and wherein the means for maintaining comprises:

means for pumping said mixture from the ullage space until the pressure less than atmospheric pressure is established.

5. The system according to claim 1 wherein said means for creating comprises:

a pump.

6. The system according to claim 5 wherein the means for maintaining further comprises:

a duct connecting the means for pumping to the ullage space of the ship's tank.

7. The system according to claim 6 further comprising:

an enclosure protecting an opening of the duct at the tank from oil or other liquid intrusion.

8. The system according to claim 7 wherein the enclosure comprises:

an air chamber.

9. The system according to claim 1 wherein the means for creating comprises:

means for controlling a flow of inert gas to the tank.

10. The system according to claim 6 wherein the means for controlling comprises:

a valve for controlling a flow of the inert gas; and an air pump for providing the flow of the inert gas.

11. The system according to claim 10 wherein the means for controlling further comprises:

a motor for driving the valve to an open and a shut condition.

12. The system according to claim 1 wherein the means for maintaining further comprise:

means for monitoring the pressure less than atmospheric pressure within the ullage space of the ship's tank; and a vacuum sub-system comprising:

pump means for controllably creating and maintaining the pressure less than atmospheric pressure in the ruptured tank; and a computer, responsive to the means for monitoring, for controlling the pump means so as to produce and maintain the pressure that is less than atmospheric pressure.

13. The system according to claim 1 further comprising:

a non-structural barrier to cover the rupture when such rupture occurs at an underwater location of the ship's tank in order to reduce surface tension dynamics and stratified flow between the oil within the tank and the surrounding water through the rupture.

14. The system according to claim 1 further comprising:

a barrier means for covering the rupture when such rupture occurs at a location at or above the ship's waterline in order to augment the balance of forces maintained on the oil contents of the ruptured tank by the means for maintaining.

15. The system according to claim 14 wherein the barrier means comprises:

a physical barrier.

16. The system according to claim 15 wherein said physical barrier is flexible.

17. The system according to claim 15 wherein said flexible physical barrier comprises:

a tarpaulin.

18. A system to reduce spillage of oil from a ruptured ship's tank, the system comprising:

inerting means for maintaining a gaseous mixture enhanced with inert gas in an ullage space above oil within a tank containing oil within a ship, the mixture being sufficiently enhanced with the inert gas so as to reduce the flammability of hydrocarbon vapors and air in this ullage space;

vacuum means controllable for maintaining a gaseous pressure of controlled magnitude within the ullage space to be less than atmospheric pressure nonetheless that mixture of gases therein is enhanced in inert gas; and control means for controlling the vacuum means so as to maintain a balance of forces acting upon the oil within the tank upon occasion of the tank's rupture so as to impede spillage of oil from the tank through the rupture.

19. A method of managing both the gases and the gas pressures within an ullage space of a ship's tank containing oil, the method comprising:

establishing and maintaining a plurality of individual gases, both flammable and nonflammable, within an ullage space of a ship's tank, which tank contains oil, in such relative proportion so as to be, as an aggregate mixture of gases, non-explosive; meanwhile simultaneously maintaining substantially continuously during a voyage of the ship a gas pressure of the mixture of gases within the ullage space to be of a magnitude less than atmospheric pressure.

20. The method according to claim 19 wherein the maintaining comprises:

constantly and dynamically maintaining the ullage space gas pressure $P_v$, which ullage space gas pressure is less than atmospheric pressure, to be of a magnitude which, when added to an instaneous hydrostatic pressure of the oil at a height $h_i$ above any rupture of the tank, will equal an external pressure $P_E$ that is occurring at the highest point of said rupture to the tank;

wherein said external pressure $P_E$ is itself equal to the atmospheric pressure $P_A$ plus a hydrostatic water pressure occurring at a height $h_e$ of the ship's waterline above said highest point of the rupture;

wherein because an internal pressure within the tank, which internal pressure equals the controlled ullage pressure $P_v$ plus the hydrostatic oil pressure, is dynamically maintained equal to said external pressure $P_E$, which external pressure equals the uncontrolled atmospheric pressure $P_A$ plus the hydrostatic water pressure, any oil out-flow, or spillage, from the tank is substantially prevented from points above said highest point of the rupture.

21. The method according to claim 19 further comprising upon the occurrence of any rupture to the ship's tank which rupture is below the ship's waterline:

placing a non-structural barrier at the location of the rupture to the tank that is below the ship's waterline, and in position between the oil that is within the tank and the surrounding water, so as to aid, by avoidance of stratified flow, said oil outflow, or spillage, from points below said highest point of the rupture.

22. A system for simultaneously managing the (i) composition nd the (ii) pressure of a plurality of gases within an ullage space of a ship's tank containing fluid where any spillage of such fluid from the tank upon any rupture to the tank is desired, insofar as is possible, to be avoided, the system comprising:

partial vacuum means for creating and maintaining a pressure, less than atmospheric pressure, in the ullage space of the ship's tank so that pressure forces acting on the fluid contents of the tank should be maintained in balance regardless that such forces should vary upon the occasion of any rupture of the tank; and inert gas means for introducing an inert gas into the ullage space of the ship's tank sufficient in amount so as to render a resulting mixture of a plurality of gases, including the inert gas, within the ullage space to be non-explosive, this introducing being simultaneously with, and regardless that, the partial vacuum means is creating and maintaining the pressure less than atmospheric pressure.

* * * * *